US010943567B2

(12) United States Patent
Wang

(10) Patent No.: US 10,943,567 B2
(45) Date of Patent: Mar. 9, 2021

(54) ENDPIN

(71) Applicant: Yin-Chieh Wang, Taipei (TW)

(72) Inventor: Yin-Chieh Wang, Taipei (TW)

( * ) Notice: Subject to any disclaimer, the term of this patent is extended or adjusted under 35 U.S.C. 154(b) by 0 days.

(21) Appl. No.: 16/920,293

(22) Filed: Jul. 2, 2020

(65) Prior Publication Data

US 2021/0035538 A1 Feb. 4, 2021

(30) Foreign Application Priority Data

Jul. 31, 2019 (TW) ..... 108127131

(51) Int. Cl.
*G10D 3/01* (2020.01)
*G10G 5/00* (2006.01)

(52) U.S. Cl.
CPC ..... *G10D 3/01* (2020.02); *G10G 5/005* (2013.01)

(58) Field of Classification Search
CPC ..... G10D 3/01; G10G 5/005
See application file for complete search history.

(56) References Cited

FOREIGN PATENT DOCUMENTS

JP 6142972 B1 * 6/2017 ..... G10D 13/02

* cited by examiner

*Primary Examiner* — Kimberly R Lockett
(74) *Attorney, Agent, or Firm* — Hamre, Schumann, Mueller & Larson, P.C.

(57) ABSTRACT

An endpin is adapted to be installed on a string instrument and adapted to abut against a supporting surface. The endpin includes a stick body and a sound-enhancing dish. The stick body has a connecting end adapted for mounting to the string instrument, and a pointed abutting end adapted for abutting against the supporting surface. The sound-enhancing dish is sleeved on and mounted to the stick body, and has an opening facing the connecting end of the stick body.

9 Claims, 13 Drawing Sheets
(4 of 13 Drawing Sheet(s) Filed in Color)

ENDPIN

CROSS-REFERENCE TO RELATED APPLICATION

This application claims priority of Taiwanese Invention Patent Application No. 108127131, filed on Jul. 31, 2019.

FIELD

The disclosure relates to an endpin, more particularly to an endpin including a sound-enhancing dish and sound grooves.

BACKGROUND

When a performer plays a large string instrument, such as a cello, the weight of the string instrument is supported by an endpin which is attached to the bottom of the string instrument and abuts against a surface such as a floor, a stopper, a podium, etc. The structure and design of the endpin are important as it may greatly affect the sound quality, the volume, and the projection ability as well as the playability of the string instrument.

SUMMARY

Therefore, the object of the disclosure is to provide an endpin that improves sound quality, sonority, and playability of a string instrument.

According to the disclosure, an endpin is adapted to be installed on a string instrument and adapted to abut against a supporting surface. The endpin includes a stick body and a sound-enhancing dish.

The stick body has a connecting end adapted for mounting to the string instrument, and a pointed abutting end adapted for abutting against the supporting surface.

The sound-enhancing dish is sleeved on and mounted to the stick body, and has an opening facing the connecting end of the stick body.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Other features and advantages of the disclosure will become apparent in the following detailed description of the embodiment with reference to the accompanying drawings, of which.

DETAILED DESCRIPTION

Figure 1:
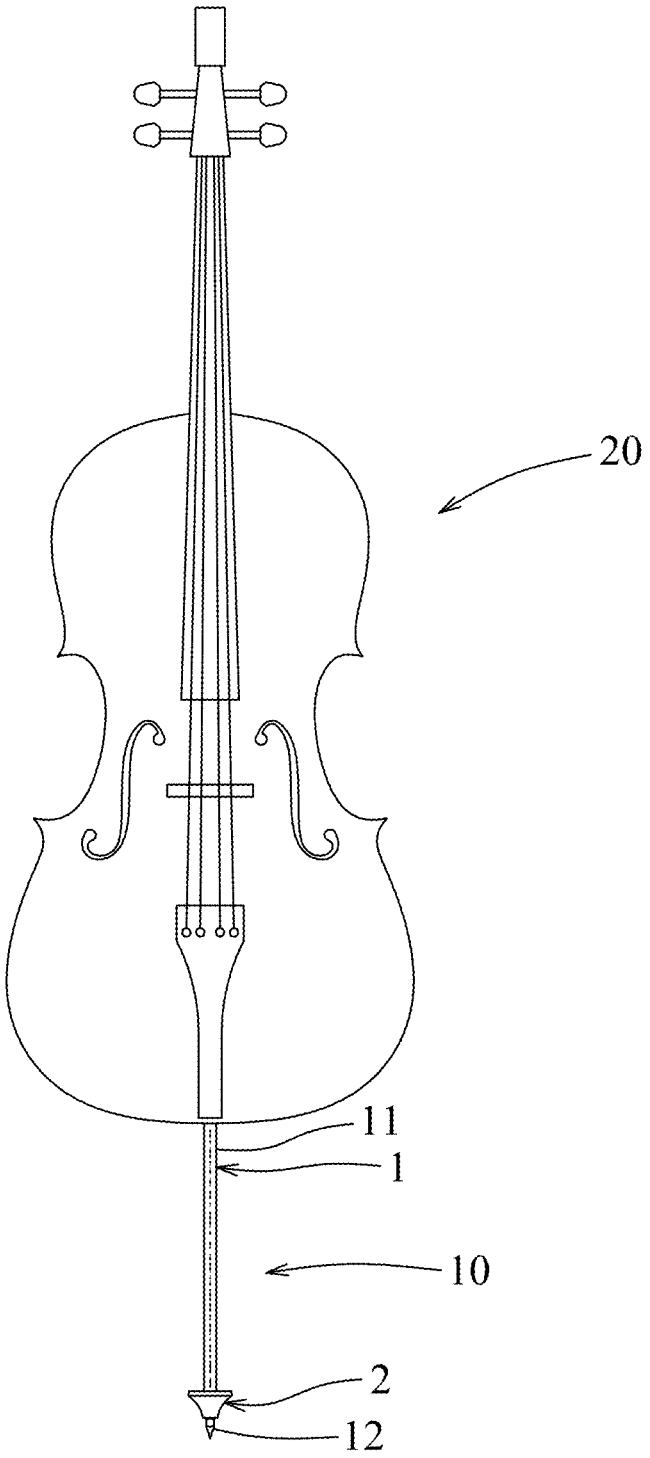
FIG. 1 is a schematic view of an embodiment of an endpin according to the disclosure and a string instrument.

Referring to FIG. 1, an embodiment of an endpin 10 is adapted to be installed on a string instrument 20 and adapted to abut against a supporting surface (not shown). The endpin 10 includes a stick body 1 extending in a vertical direction, and a sound-enhancing dish 2. In this embodiment, the string instrument 20 is a cello. The string instrument 20 may be a double bass in another embodiment and is not limited to the disclosure herein.

The stick body 1 has a connecting end 11 adapted for mounting to a bottom of the string instrument 20, and a pointed abutting end 12 adapted for abutting against the supporting surface. The stick body 1 is made of a composite material which is a combination of two or more constitute materials selected from a group consisting of metal, wood, ceramic, carbon fiber, glass fiber, and polymers. The constitute materials in the combination may be joined together by socketing, assembly, bonding, welding, melting, etc. Stick bodies made of different materials help the string instrument 20 produce sounds with different characteristics. The stick body 1 of this disclosure being made of a composite material allows the timbre of the string instrument 20 to be richer. Different compositions of constitute materials may also be configured to match different types of the string instrument 20. It is noted that in other embodiments, the stick body 1 may be made of a single material. The abutting end 12 being pointed helps a performer to securely position the string instrument 20 against the supporting surface and reduces the contact area between the endpin 10 and the supporting surface to enable the string instrument 20 to maintain good resonance so as to produce more pleasant sounds.

Figure 16:
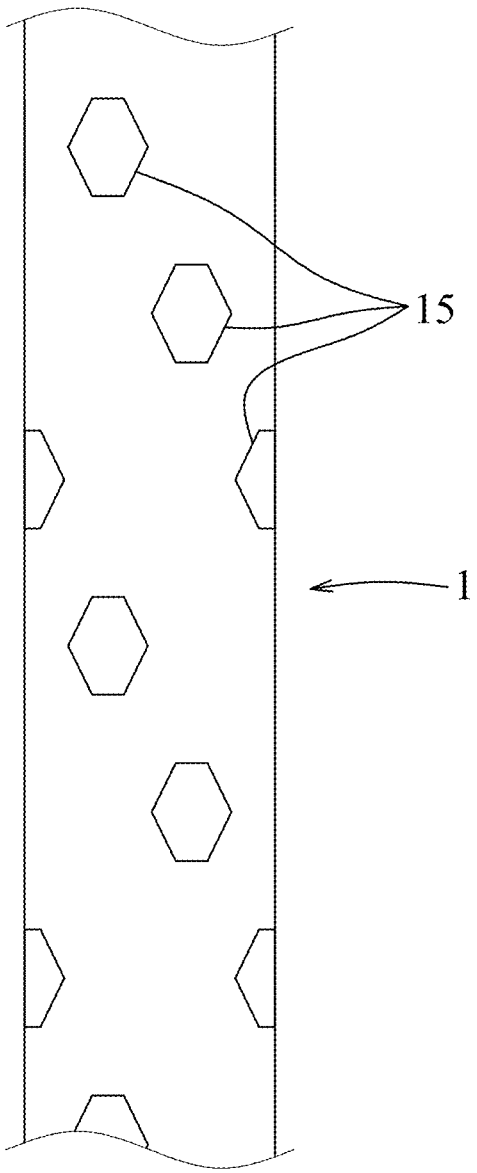
FIG. 16 is a view similar to FIG. 5 but illustrating the sound grooves having a polygonal shape.
Figure 17:
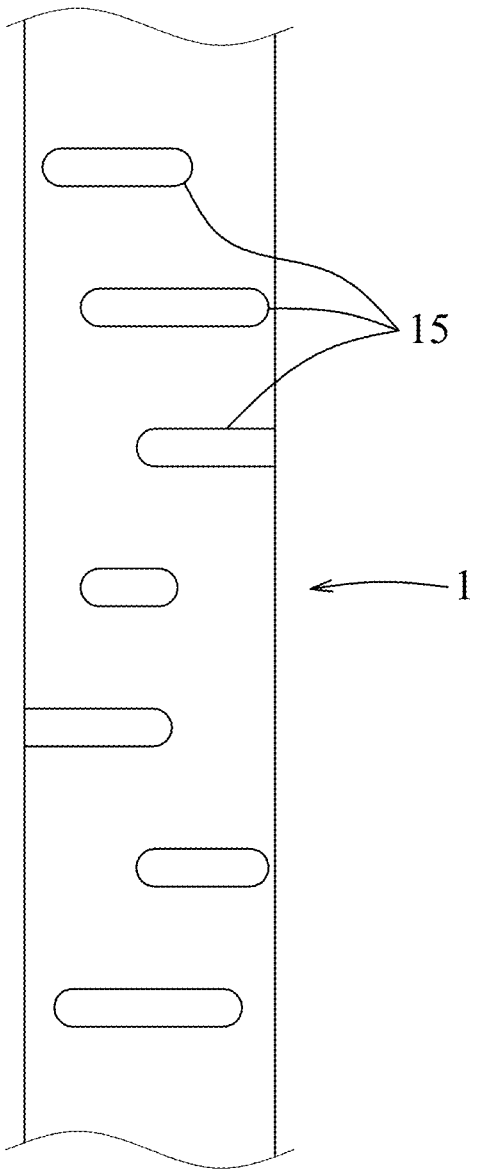
FIG. 17 is a view similar to FIG. 5 but illustrating the sound grooves extending transversely.

Referring to FIGS. 2, 5, and 15 to 17, the stick body 1 is formed with a plurality of sound grooves 15. Each of the sound grooves 15 has an elongated shape and is elongated in a direction parallel (FIG. 5) to or transverse (FIG. 17) to a direction in which the stick body 1 is elongated, or in a spiral direction (FIG. 15), or has a polygonal shape (FIG. 16). In this embodiment, each of the sound grooves 15 is elongated in a direction parallel to the direction in which the stick body 1 is elongated, and has rounded ends. In this embodiment, the sound grooves 15 have a range of lengths. In other embodiments, the sound grooves 15 may each have square ends, are of the same lengths, have other irregular shapes, and/or are distributed irregularly on the stick body 1. The provision of the sound grooves 15 disturbs the waveform of the sound produced by the string instrument 20 to increase the complexity of audio frequencies so that more overtones are produced during resonance to enrich the sound quality.

Figure 2:
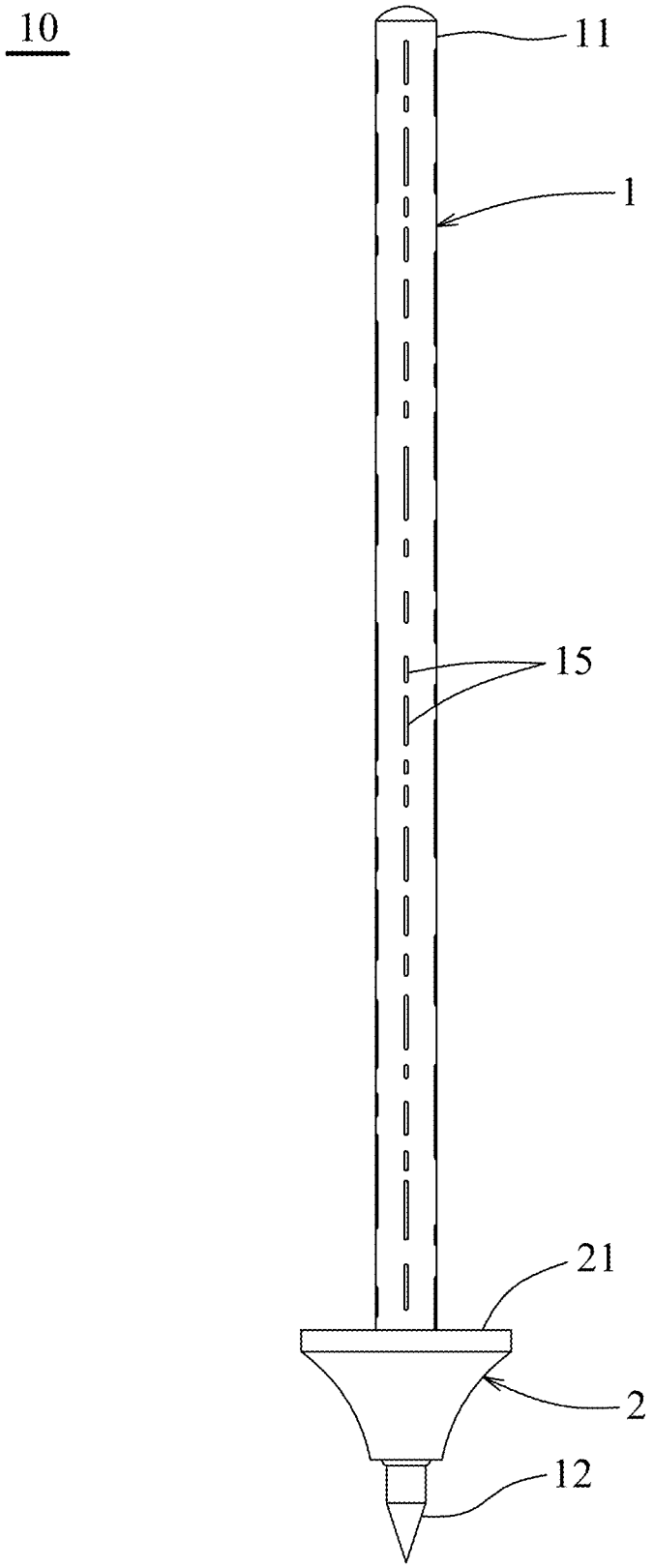
FIG. 2 is a schematic front view of the embodiment.

Referring to FIGS. 1 and 2, the sound-enhancing dish 2 is sleeved on and mounted to the stick body 1, and has an opening 21 facing the connecting end 11 of the stick body 1. The sound-enhancing dish 2 is proximal to the abutting end 12 of the stick body 1. The sound-enhancing dish 2 may have a round shape as in this embodiment, or a polygonal shape (not shown). The sound-enhancing dish 2 feedbacks sound waves produced by the string instrument 20 to improve the resonance in the body of the string instrument 20, thereby improving the sound quality and volume of the string instrument 20. Moreover, the sound-enhancing dish 2 being disposed proximal to the abutting end 12 of the stick body 1 helps optimize the mass distribution of the endpin 10 so as to improve stability of the string instrument 20 during a performance. In this embodiment, the sound-enhancing dish 2 is sleeved on the stick body 1, but is not limited thus and may be formed in one piece with the stick body 1 in other embodiments.

Figure 3:
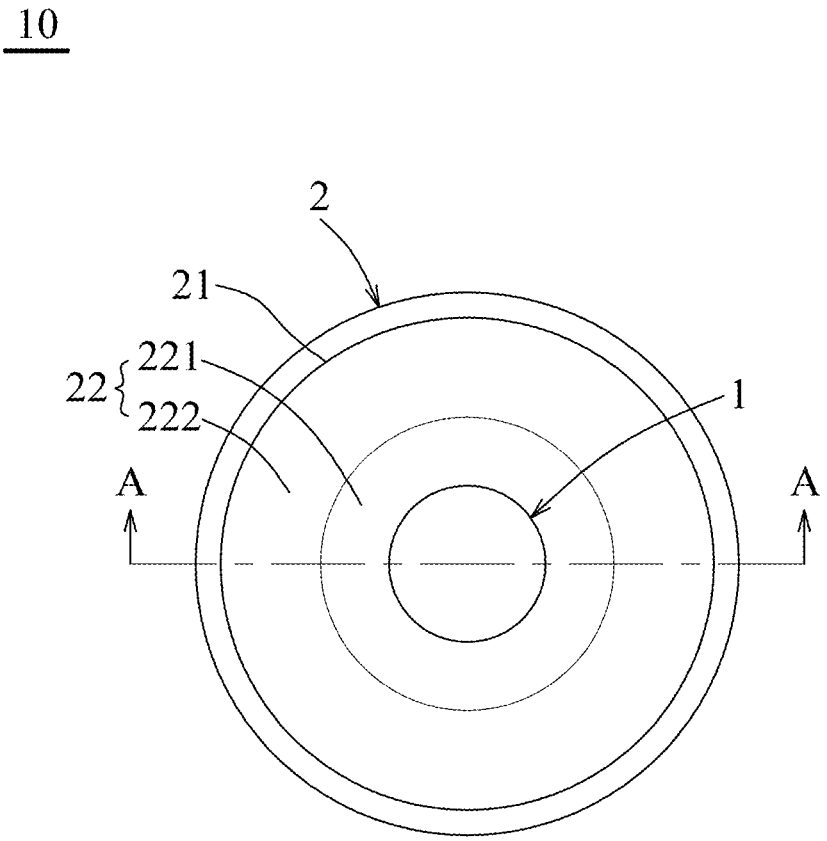
FIG. 3 is a schematic top view of the embodiment.
Figure 4:
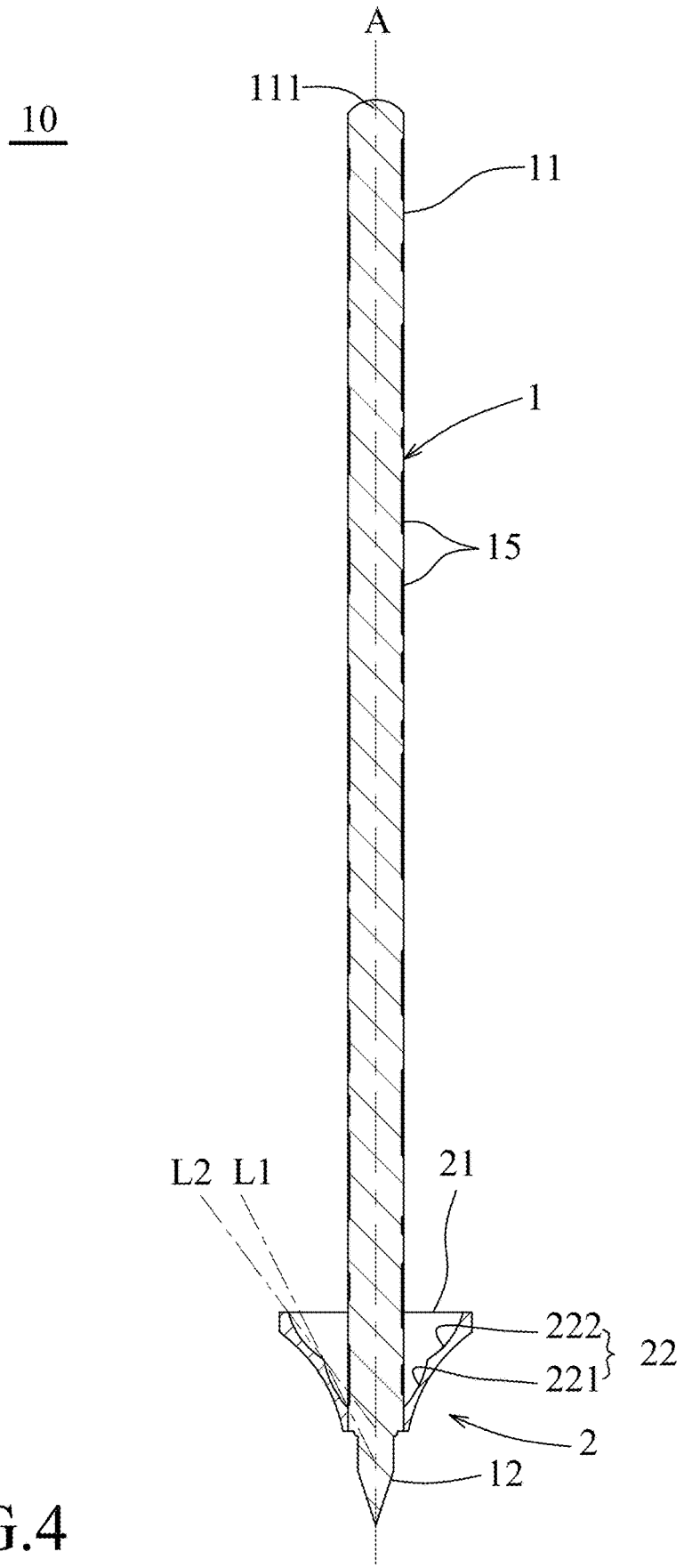
FIG. 4 is a schematic sectional view of the embodiment taken along line A-A in FIG. 3.
Figure 5:
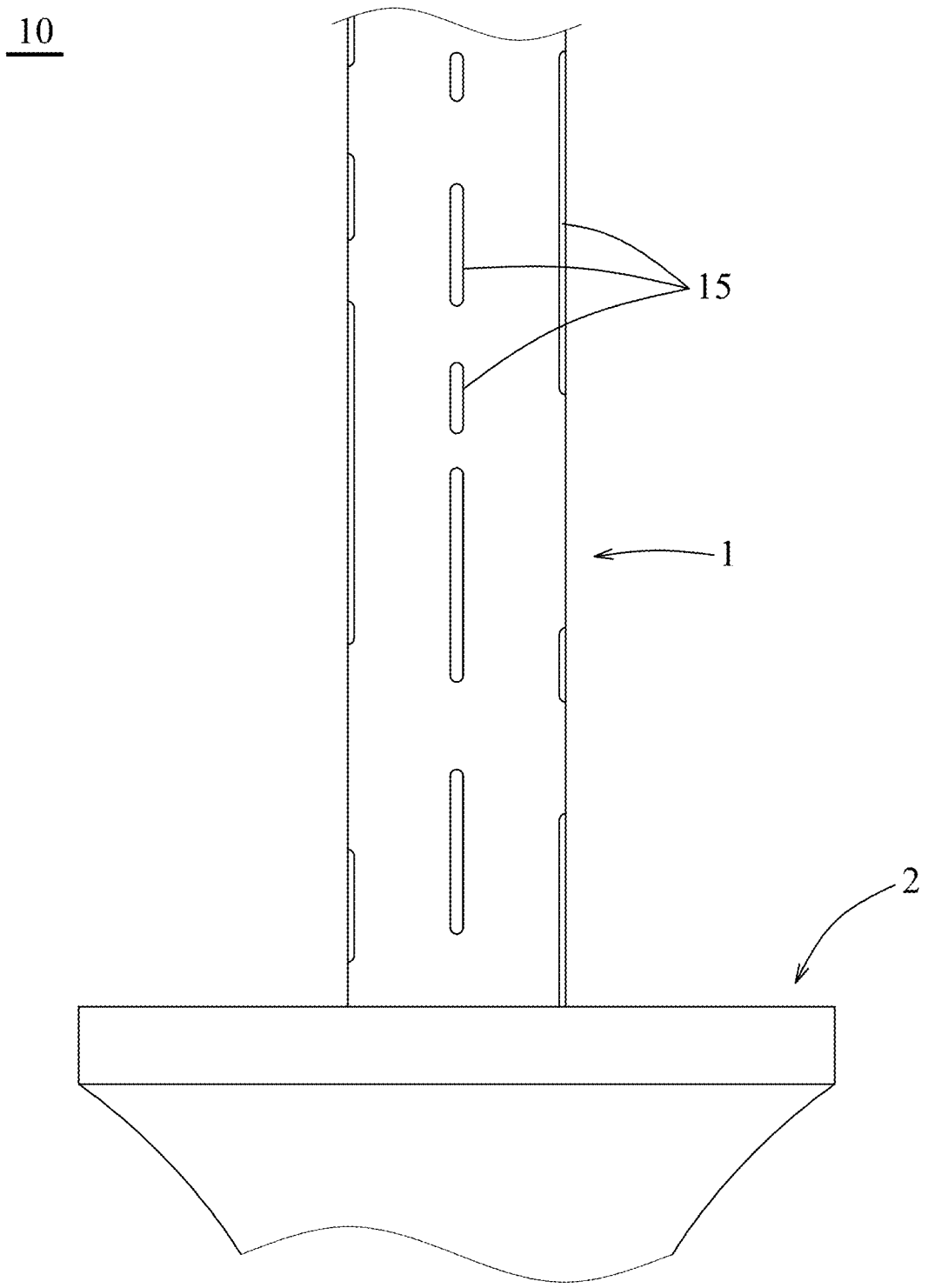
FIG. 5 is a fragmentary schematic front view of the embodiment.

Referring to FIGS. 3 and 4, the sound-enhancing dish 2 further has an inner surface 22 defining the opening 21 and facing the connecting end 11 of the stick body 1. The inner surface 22 has a first surrounding portion 221 and a second surrounding portion 222 extending outwardly from an outer periphery of the first surrounding portion 221. The first and second surrounding portions 221, 222 of the inner surface 22 of the sound-enhancing dish 2 are concave with respect to the stick body 1.

The first and second surrounding portions 221, 222 respectively define first and second imaginary lines (L1, L2). A cross-section of each of the first and second surrounding portions 221, 222 is defined by the intersection thereof with a plane containing a central axis (A) of the stick body 1. Each of the first and second imaginary lines (L1, L2) extends through two ends of a segment that is included in the cross-section of a respective one of the first and second surrounding portions 221, 222 and passes through the central axis (A) of the stick body 1. An angle between the second imaginary line (L2) and the central axis (A) is larger than an angle between the first imaginary line (L1) and the central axis (A). The difference in tilts of the first and second surrounding portions 221, 222 relative to the stick body 1 helps focus the sound waves.

Figure 14:
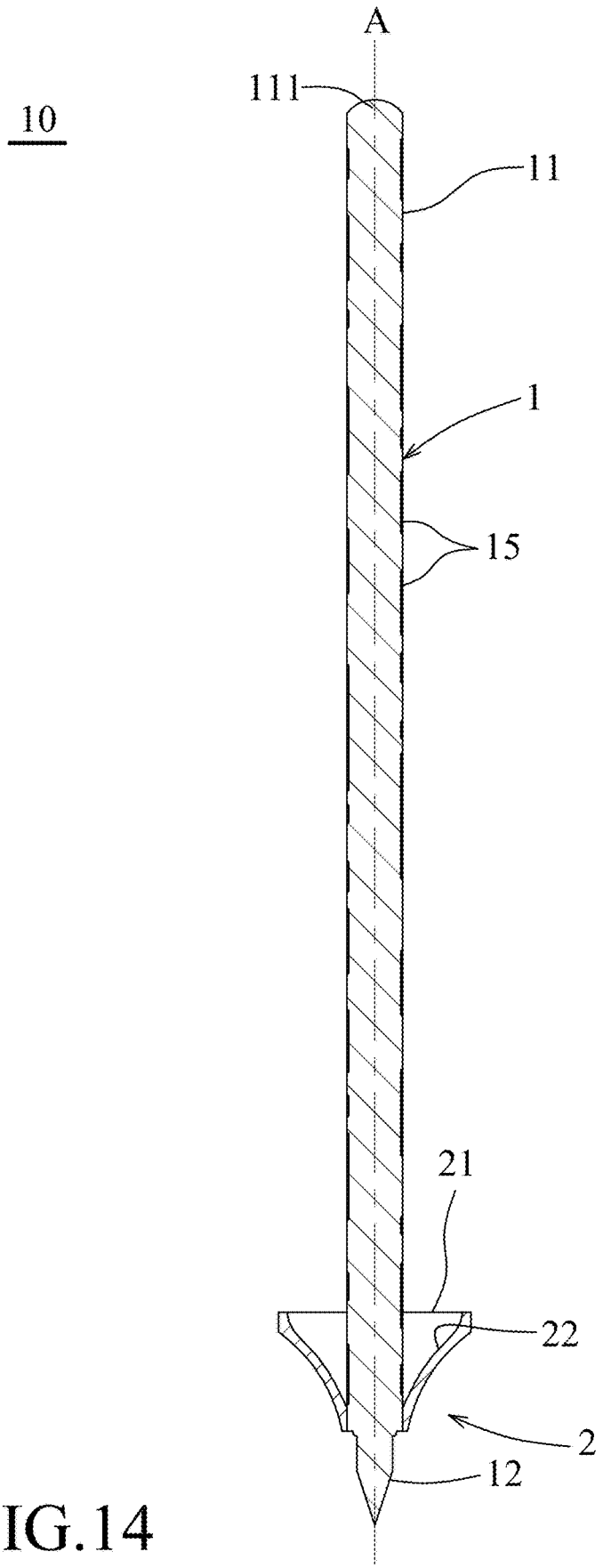
FIG. 14 is a view similar to FIG. 4 but illustrating a variation of the embodiment.
Figure 15:
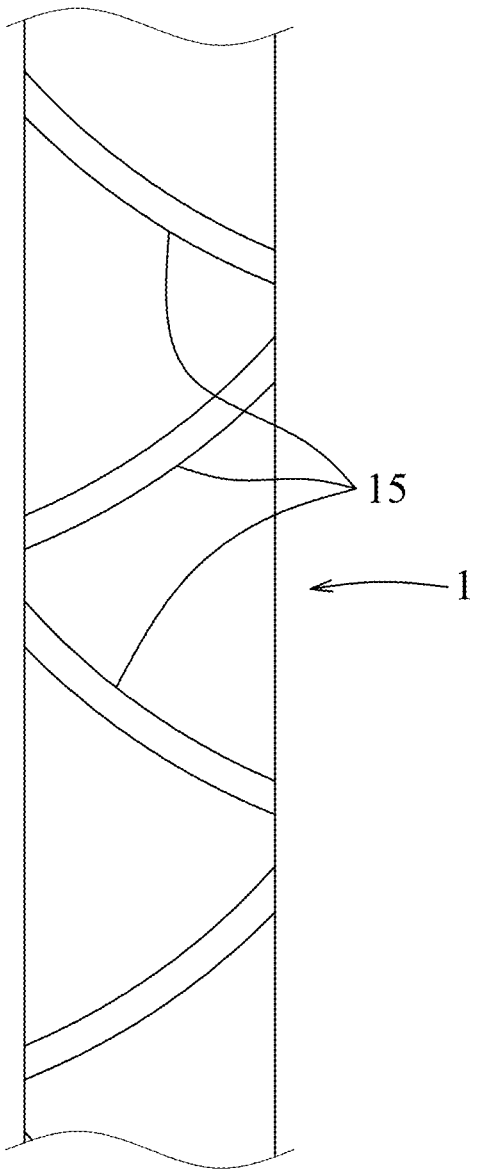
FIG. 15 is a view similar to FIG. 5 but illustrating sound grooves of the embodiment having a spiral shape

Referring to FIG. 14, in certain embodiments, the inner surface 22 is not divided into the first and second surrounding portions 221, 222, and is concave with respect to the stick body 1. In other words, the inner surface 22 may be a single surrounding curved surface.

Effects of the embodiment of the disclosure will now be explained in more detail below by way of comparisons between recordings made by playing the cello installed with the endpin 10 of the disclosure (referred to as Test Example), and the same cello installed with a conventional endpin (referred to as Comparison Example). Two sound recordings were made in each of the experiments by having the same performer play Test Example and Comparative Example, respectively.

FIRST EXPERIMENT

In the first experiment, a single note was played on Test Example and Comparative Example and recorded to produce two sound recordings.

Figure 6:
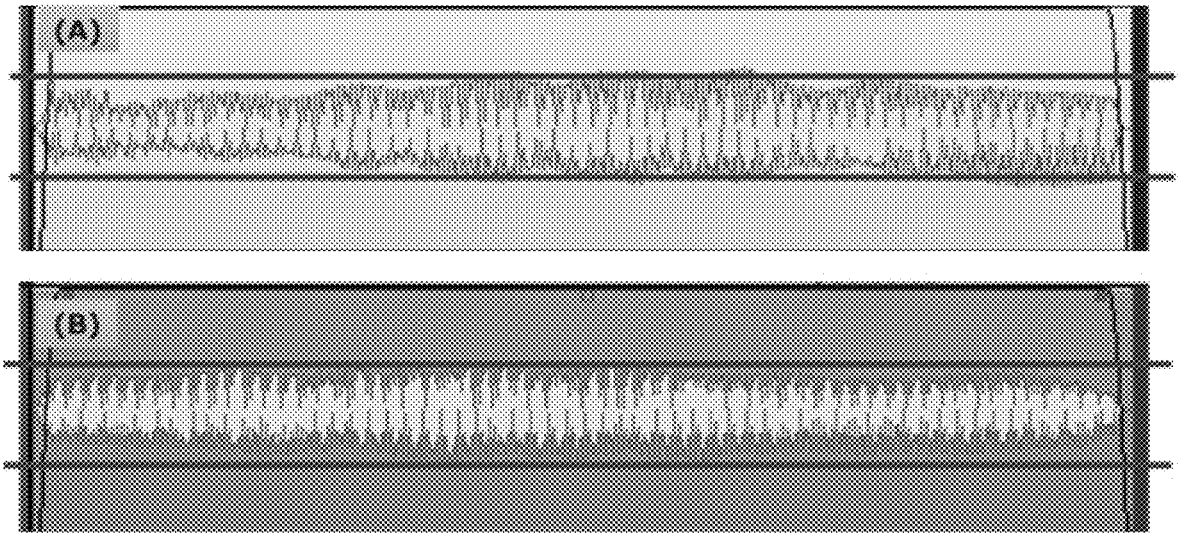
FIG. 6 is a graph of waveforms of sound recordings of Test Example and Comparative Example playing one note.

FIG. 6 includes waveform graphs of the sound recording of Test Example (labeled (A)) and the recording of Comparative Example (labeled (B)), where the horizontal axis is time and the vertical axis is amplitude. Horizontal lines on each of the waveform graphs (A) and (B) mark out the same amplitude range on both graphs. As shown in FIG. 6, Test Example produced sound output with a more stable amplitude and volume.

Figure 7:
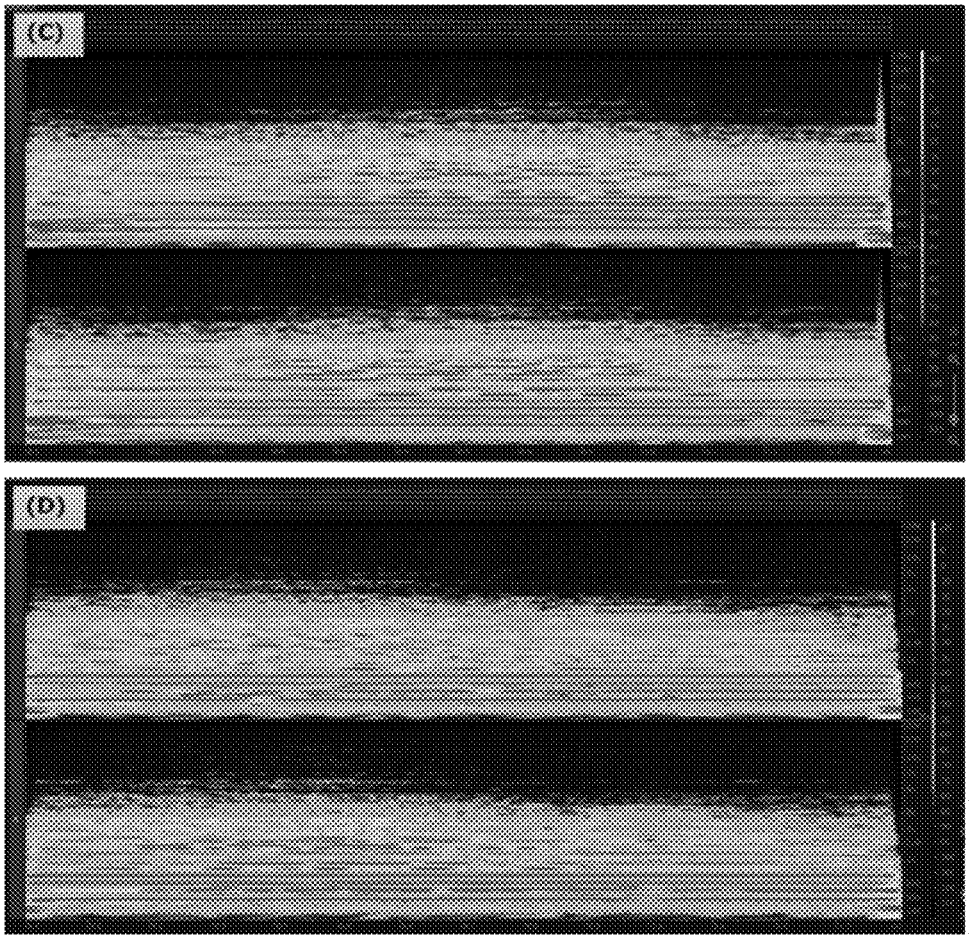
FIG. 7 is a graph of spectrograms of the sound recordings of Test Example and Comparative Example playing one note.

FIG. 7 includes spectrograms of the sound recording of Test Example (labeled as (C)) and the sound recording of Comparative Example (labeled as (D)), where the horizontal axis is time and the vertical axis is frequency. In these spectrograms, the color represents intensity. As shown in FIG. 7, Test Example produces more stable and richer sound output at fundamental frequency and overtones than Comparative Example.

SECOND EXPERIMENT

Figure 8:
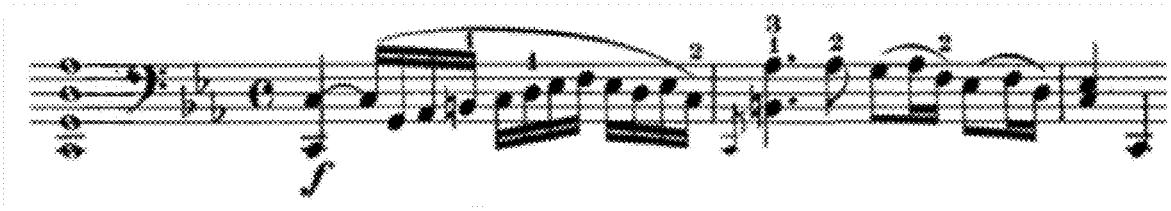
FIG. 8 is a sheet music of a section excerpted from Bach Cello Suite No. 5 Prelude.

In the second experiment, a section of Bach Cello Suite No. 5 Prelude (bar 1-bar 3 beat 2, see FIG. 8) was played on Test Example and Comparative Example and recorded to produce two sound recordings.

Figure 9:
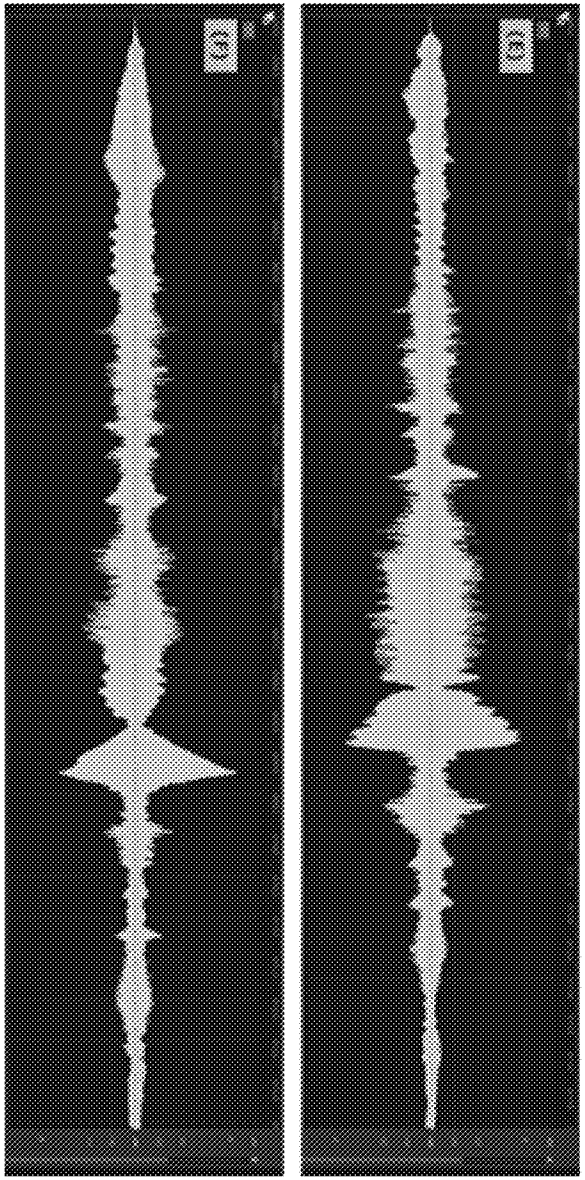
FIG. 9 is a graph of waveforms of sound recordings of Test Example and Comparative Example playing the notes of FIG. 8.

FIG. 9 includes waveform graphs of the sound recording of Test Example (labeled (E)) and the sound recording of Comparative Example (labeled (F)), where the horizontal axis is time and the vertical axis is amplitude. As shown in FIG. 9, Test Example produced better average volume and brought more sustainable sound than Comparative Example.

Figure 10:
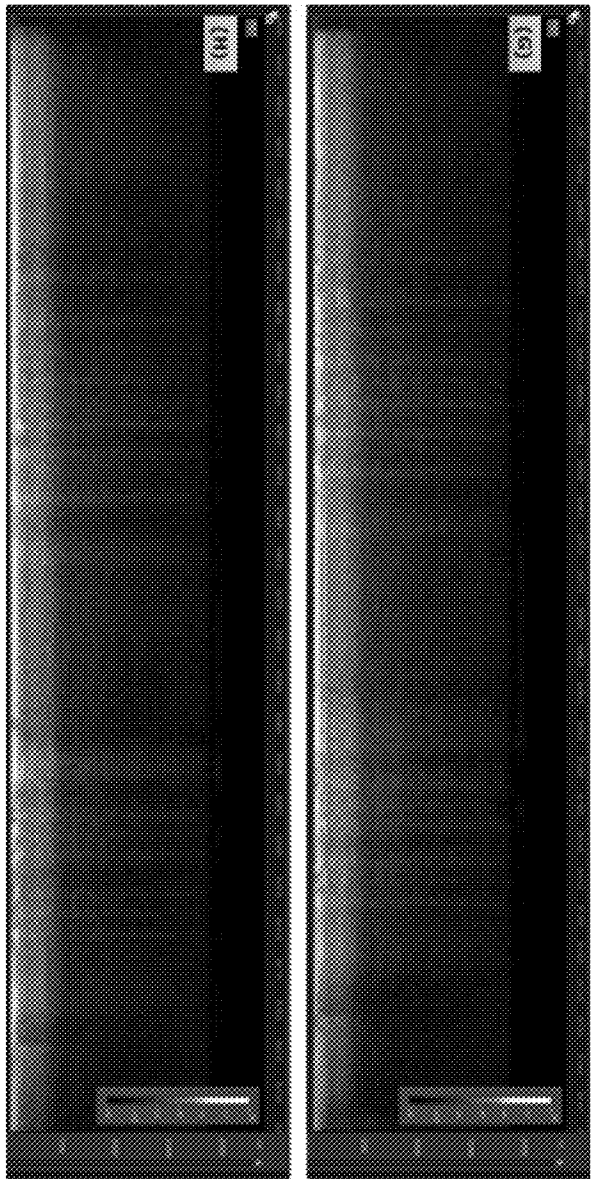
FIG. 10 is a graph of spectrograms of the sound recordings of Test Example and Comparative Example playing the notes of FIG. 8.

FIG. 10 includes spectrograms of the sound recording of Test Example (labeled as (G)) and the sound recording of Comparative Example (labeled as (H)), where the horizontal axis is time and the vertical axis is frequency. In these spectrograms, visual brightness represents intensity. As shown in FIG. 10, Test Example produced more stable and richer sound output at fundamental frequency and overtones than Comparative Example.

THIRD EXPERIMENT

Figure 11:
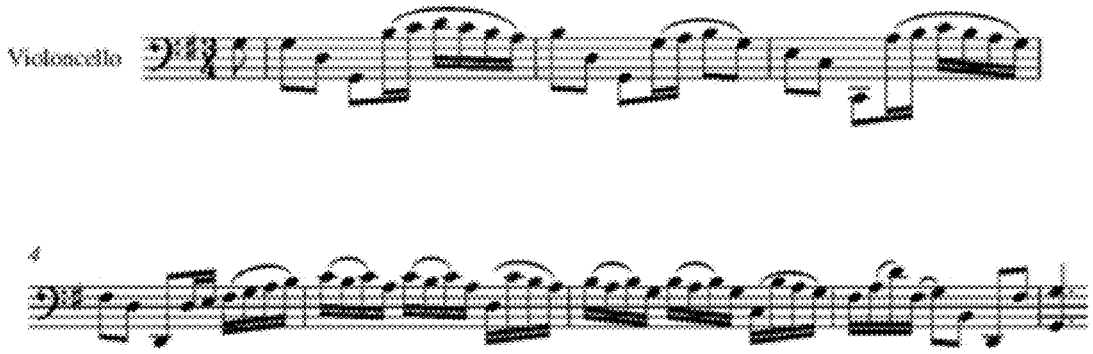
FIG. 11 is a sheet music of a section excerpted from Bach Cello Suite No. 1 Courante.

In the third experiment, a section of Bach Cello Suite No. 1 Courante (bar 1-bar 8 beat 2 first half, see FIG. 11) was played on Test Example and Comparative Example and recorded to produce two sound recordings.

Figure 12:
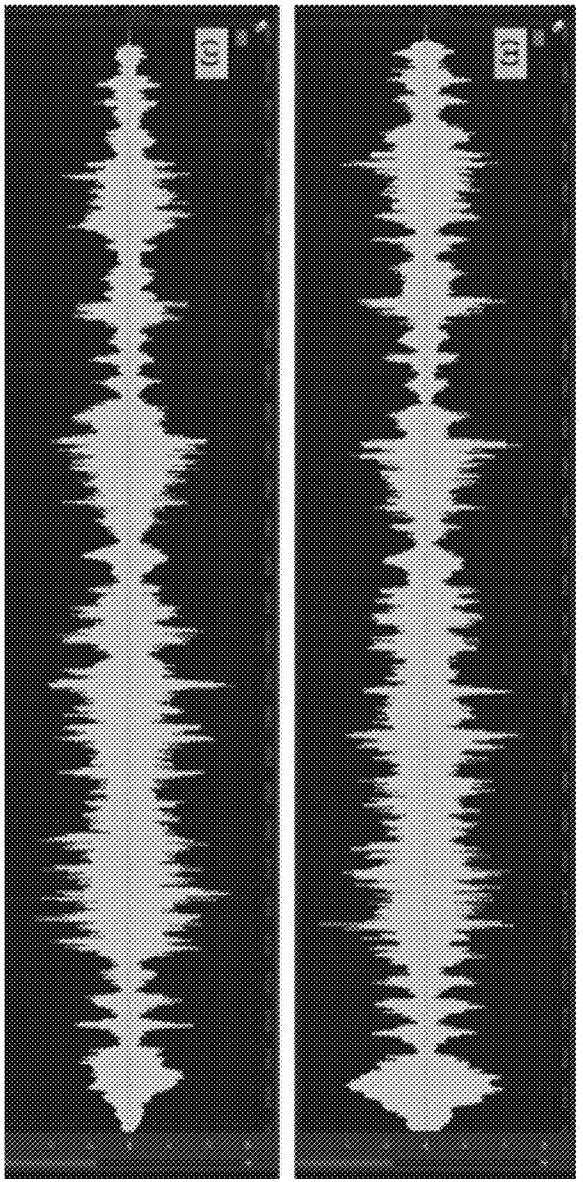
FIG. 12 is a graph of waveforms of sound recordings of Test Example and Comparative Example playing the notes of FIG. 11.

FIG. 12 includes waveform graphs of the sound recording of Test Example (labeled (I)) and the sound recording of Comparative Example (labeled J), where the horizontal axis is time and the vertical axis is amplitude. As shown in FIG. 12, Test Example produced better average volume and brought more sustainable sound than the Comparative Example.

Figure 13:
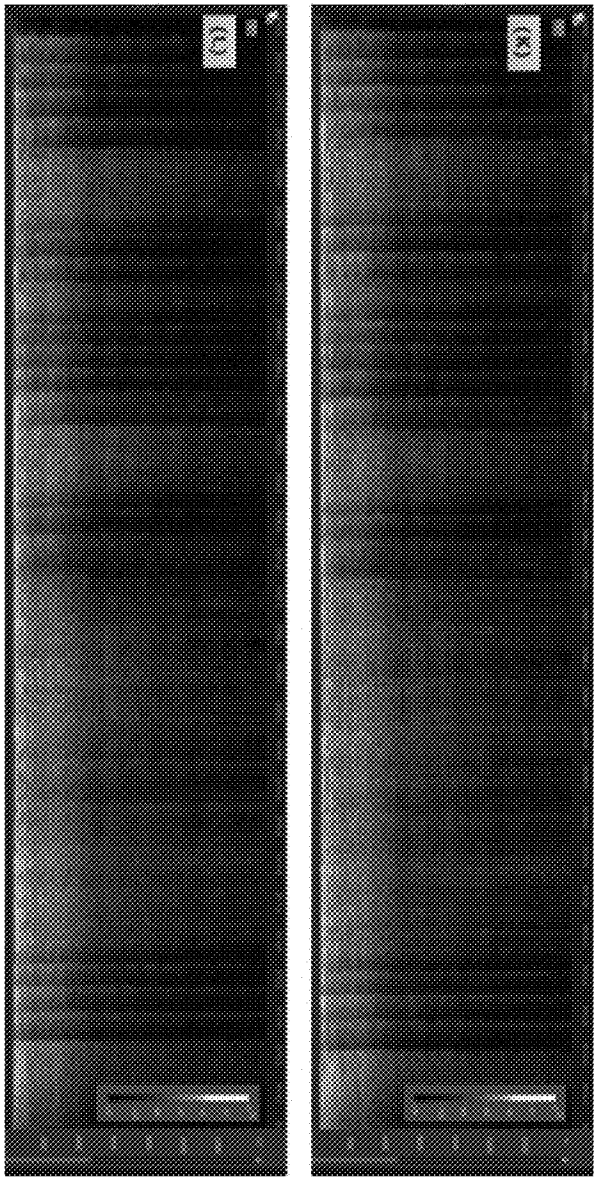
FIG. 13 is a graph of spectrograms of the sound recordings of Test Example and Comparative Example playing the notes of FIG. 11

FIG. 13 includes spectrograms of the sound recording of Test Example (labeled as (K)) and the sound recording of Comparative Example (labeled as (L)), where the horizontal axis is time and the vertical axis is frequency. In these spectrograms, visual brightness represents intensity. As shown in FIG. 13, Test Example produced more stable and richer sound output at fundamental frequency and overtones than Comparative Example.

To sum up, by virtue of the sound-enhancing dish 2 sleeved on the stick body 1 and the sound grooves 15 formed on the stick body 1, the string instrument 20 may have more focused, more powerful, and richer sound output.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number, and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An endpin adapted to be installed on a string instrument and adapted to abut against a supporting surface, said endpin comprising:

a stick body having a connecting end that is adapted for mounting to the string instrument, and a pointed abutting end that is adapted for abutting against the supporting surface; and a sound-enhancing dish sleeved on and mounted to said stick body, said sound-enhancing dish having an opening that faces said connecting end of said stick body.

2. The endpin as claimed in claim 1, wherein said sound-enhancing dish is proximal to said abutting end of said stick body.

3. The endpin as claimed in claim 2, wherein:

said sound-enhancing dish further has an inner surface defining said opening and facing said connecting end of said stick body, said inner surface having a first surrounding portion and a second surrounding portion that extends outwardly from an outer periphery of said first surrounding portion; and said first and second surrounding portions respectively define first and second imaginary lines, each of said first and second imaginary lines extending through two ends of a segment that is included in a cross-section of a respective one of said first and second surrounding portions, and passing through a central axis of said stick body, where the cross-section is defined by intersection of the respective one of said first and second surrounding portions with a plane containing the central-axis, an angle between said second imaginary line and the central axis being larger than an angle between said first imaginary line and the central axis.

4. The endpin as claimed in claim 3, wherein said first and second surrounding portions of said inner surface of said sound-enhancing dish are concave with respect to said stick body.

5. The endpin as claimed in claim 2, wherein said sound-enhancing dish further has an inner surface defining said opening and facing said connecting end of said stick body, said inner surface being concave with respect to said stick body.

6. The endpin as claimed in claim 1, wherein said stick body is formed with a plurality of sound grooves.

7. The endpin as claimed in claim 6, wherein each of said sound grooves has one of an elongated shape and a polygonal shape.

8. The endpin as claimed in claim 6, wherein each of said sound grooves is elongated in a direction that is one of parallel and transverse to a direction in which said stick body is elongated.

9. The endpin as claimed in claim 1, wherein said stick body is made of a composite material.

* * * * *